US010428473B1

(12) United States Patent
Gassman

(10) Patent No.: US 10,428,473 B1
(45) Date of Patent: Oct. 1, 2019

(54) SINUOUS TRAFFIC LINE

(71) Applicant: M.B.G. Industries, Swampscott, MA (US)

(72) Inventor: Manuel B. Gassman, Swampscott, MA (US)

(73) Assignee: M.B.G. Industries, Swampscott, MA (US)

( * ) Notice: Subject to any disclaimer, the term of this patent is extended or adjusted under 35 U.S.C. 154(b) by 0 days.

(21) Appl. No.: 16/404,884

(22) Filed: May 7, 2019

Related U.S. Application Data

(63) Continuation of application No. 14/683,127, filed on Apr. 9, 2015, now Pat. No. 10,280,574, which is a continuation-in-part of application No. 14/308,192, filed on Jun. 18, 2014, now abandoned.

(60) Provisional application No. 61/836,731, filed on Jun. 19, 2013.

(51) Int. Cl.

| | |
|---|---|
| ***E01C 23/00*** | (2006.01) |
| ***E01C 23/22*** | (2006.01) |
| ***E01F 9/576*** | (2016.01) |
| ***E01F 9/518*** | (2016.01) |
| ***E01C 23/20*** | (2006.01) |
| ***B05D 5/06*** | (2006.01) |

(52) U.S. Cl.
CPC ..... *E01C 23/22* (2013.01); *B05D 5/06* (2013.01); *E01C 23/206* (2013.01); *E01F 9/518* (2016.02); *E01F 9/578* (2016.02)

(58) Field of Classification Search
CPC ..... E01C 23/22; E01C 23/206; E01F 9/518; E01F 9/578; B05D 5/06
USPC ..... 404/12–16, 94
See application file for complete search history.

(56) References Cited

U.S. PATENT DOCUMENTS

| | | | | |
|---|---|---|---|---|
| 6,247,872 | B1 * | 6/2001 | Marcato | E01C 23/243 404/14 |
| 6,413,013 | B1 * | 7/2002 | Requena | E01C 23/185 156/355 |
| 6,504,525 | B1 * | 1/2003 | Knights | G02B 26/026 345/107 |
| 6,796,740 | B2 * | 9/2004 | Chiron | E01C 23/166 404/14 |
| 7,150,413 | B1 * | 12/2006 | Bricko | B05B 9/0403 239/150 |
| 8,021,077 | B2 * | 9/2011 | Annese | E01C 23/222 118/305 |
| 2005/0129462 | A1 * | 6/2005 | Hagenah | E01C 5/06 404/41 |
| 2007/0077119 | A1 * | 4/2007 | Northey | E01F 9/578 404/12 |

(Continued)

*Primary Examiner* — Raymond W Addie
(74) *Attorney, Agent, or Firm* — Loginov & Associates, PLLC; William A. Loginov

(57) ABSTRACT

A sinusoidal traffic line that has scalloped edges to form a sine wave that increases visibility under conditions of reduced visibility is formed of a pre-cut ribbon or applied traffic line material (e.g., sprayed thermoplastic material). The traffic lines have a wavy left edge and a wavy right edge. The edges are formed in a regular pattern, having a regular amplitude and wavelength relative to a directional vector along the axis of the traffic line. The patterns of the outer edges are arranged in an opposite arrangement such that they converge and diverge. The upper surface of the traffic line can be embossed by an embossed device so as to create a regular pattern and increase reflectivity.

20 Claims, 7 Drawing Sheets

(56) References Cited

U.S. PATENT DOCUMENTS

| | | | | |
|---|---|---|---|---|
| 2009/0202298 | A1* | 8/2009 | Bjorklund | E01C 23/166<br>404/77 |
| 2011/0195179 | A1* | 8/2011 | Davies | E01C 23/163<br>427/137 |
| 2012/0203475 | A1* | 8/2012 | Wilkens | E01C 23/20<br>702/47 |
| 2013/0190981 | A1* | 7/2013 | Dolinar | B60R 11/04<br>701/41 |
| 2014/0064849 | A1* | 3/2014 | Arnold | E01C 23/185<br>404/75 |

* cited by examiner

SINUOUS TRAFFIC LINE

RELATED APPLICATIONS

This application is a continuation of copending U.S. patent application Ser. No. 14/683,127, entitled SINUOUS TRAFFIC LINE, filed Apr. 9, 2015, which is continuation-in-part of copending U.S. patent application Ser. No. 14/308,192, filed Jun. 18, 2014, entitled SINUOUS TRAFFIC LINE, which claims the benefit of U.S. Provisional Application Ser. No. 61/836,731, Jun. 19, 2013, entitled SINUOUS TRAFFIC LINE, the entire disclosure of each of which applications is herein incorporated by reference.

FIELD OF THE INVENTION

This invention relates to systems to facilitate the traffic safety and more particularly to the arrangement and disposition of traffic lines.

BACKGROUND OF THE INVENTION

Traffic lines are an accepted device in the field of traffic safety. The earliest traffic lines were put into use by Edward N. Hines on Trenton's River Road in Wayne County, Michigan. Later refinements led to single and double lines, broken lines located in the center of the roadway and along the edges.

Traffic lines can be painted with a basic permanent paint that is optimally visible only under the best illumination. Given that roadways are travelled by day and night, in conditions of clear weather, fog, snow, sleet, smoke or other visual impairments. Under these circumstances, the paint can become invisible and increase the risks to the traveler. Furthermore, even the stoutest paint can be rubbed off the road surface by plow trucks, sand and other causes. Roadway engineers have determined that thermoplastic paints last longer than common paint and that the addition of small glass beads to the mixture creates a reflective surface that increases visibility under inclement conditions and at night. A concentration of glass beads in the paint mixture at a ratio of six pounds of beads per gallon of paint, according to current standards within the various states. This creates a heterogenous mixture. Thermoplastic traffic paint is generally applied in two coats, each of 60 mil thickness. The colors used are white and yellow. The thermoplastic paint is applied hot by spraying of extruded as a ribbon and is 4 inches in width. The glass beads are added while the mixture is still molten hot. The mixture starts as a homogenous dry mix of binder resins, plasticizers, glass beads (or similar material bead), pigments and fillers. The mixture is heated to approximately 400 degrees Fahrenheit and placed into the dispenser, which is mounted on a vehicle or a small "walk behind" manually operated device. The lines can be uniform on their upper surface or embossed with diamond or other patterns to increase reflectivity. The application of a binding agent prior to the application of the traffic line material can improve the longevity of the traffic lines.

The visibility of traffic lines remains a problem for travelers. The lines tend to be elongated ribbons of reflective material when viewed from the driver's seat. Over time, the traveler's visual acuity can degrade from fatigue and the homogeneity of the elongated lines lose their relevance, increasing the risk to the driver. FIG. 1 is a view of a roadway 100 provided with traffic lines 102 and a truck 104 that is driving with the assistance of its headlights 106 and their cast beams 108. The extent of the driver's optimal visibility is represented by broken line 110. The lines 102 are evenly spaced and stretch off into the gloom and darkness, disappearing beyond the optimal visibility extent 110. It would be desirable to provide a traffic line that is reflective and constructed and arranged to be visually stimulating and maintain the interest of the driver, thereby increasing highway safety.

SUMMARY OF THE INVENTION

This invention overcomes the disadvantages of the prior art by providing a sinusoidal traffic line that has scalloped edges to form a sine wave that increases visibility under conditions of reduced visibility, for example, during rain, night or fog. The traffic line is formed of a pre-cut ribbon or applied traffic line material (e.g., sprayed thermoplastic material). The traffic lines have a wavy left edge and a wavy right edge. The edges are formed in a regular pattern, having a regular amplitude and wavelength relative to a directional vector along the axis of the traffic line. In an embodiment, a pattern of the wavy left edge corresponds to and is identical to a pattern of the wavy right edge. The line is reflective of light and can be formed of a thermoplastic mixture to which a quantity of glass beads has been added. The sinusoidal traffic lines have a regular lateral amplitude of approximately 1 to 2 inches at a wavelength of approximately 4 to 6 inches. The longitudinal wavelength and lateral amplitude can be varied greater and lesser depending on the prevailing travel speed of the underlying road. In another embodiment, the patterns of the outer edges are arranged in an opposite arrangement such that they converge and diverge, having a regular lateral amplitude of approximately 2 to 4 inches. The upper surface of the traffic line can be embossed by an embossed device so as to create a regular pattern and increase reflectivity. In an embodiment, an embossed pattern is a diamond pattern.

The sinusoidal traffic line is created by applying a pre-cut ribbon having a regular pattern or by applying traffic line material via an applicator head and nozzle. An applicator device can be a walk-along machine or a vehicle mounted device. A mixture of traffic line material is placed into the applicator device and is pre-heated.

Thermoplastic traffic paint is pre-heated to approximately 400 degrees Fahrenheit. A pre-determined quantity of glass beads is added to the mixture and pressure is applied to carry the mixture through a feed line to an applicator head that is provided with a nozzle. The applicator head is set at a pre-determined elevation. The applicator head is moved laterally relative to the direction of travel and the applicator device forward travel rate is set such that lines having the desired amplitude and wavelength are created. The applicator device can be provided with an embossing device to create a regular pattern on the upper line surface (i.e., a diamond pattern) to increase reflectivity. In other embodiments, the nozzle can have variable geometry walls to create the sinusoidal line, a rotatable off-center nozzle head or a swinging nozzle head.

The sinusoidal traffic lines describe a contiguous assembly of three parallel line portions with a first portion having a concentration of glass beads per gallon of paint that is different from the concentration of glass beads per gallon of paint of a second portion; the second portion being the outermost portions of the traffic line. Each of the second portions is a side margin with a width of one quarter inch. The concentration of glass beads in the paint within the second portions is four times that of the first portion. The increased concentration of glass beads in the second portion is at a ratio of twenty-four pounds of glass beads per gallon of paint. The increased concentration of glass beads in the second portion increases the visibility of the edges of the traffic lines. The sinusoidal traffic line increases visibility of the traffic lines in periods of reduced visibility. Each of the second portions has a different width relative to the other.

BRIEF DESCRIPTION OF THE DRAWINGS

The invention description below refers to the accompanying drawings, of which.

DETAILED DESCRIPTION

Figure 1:
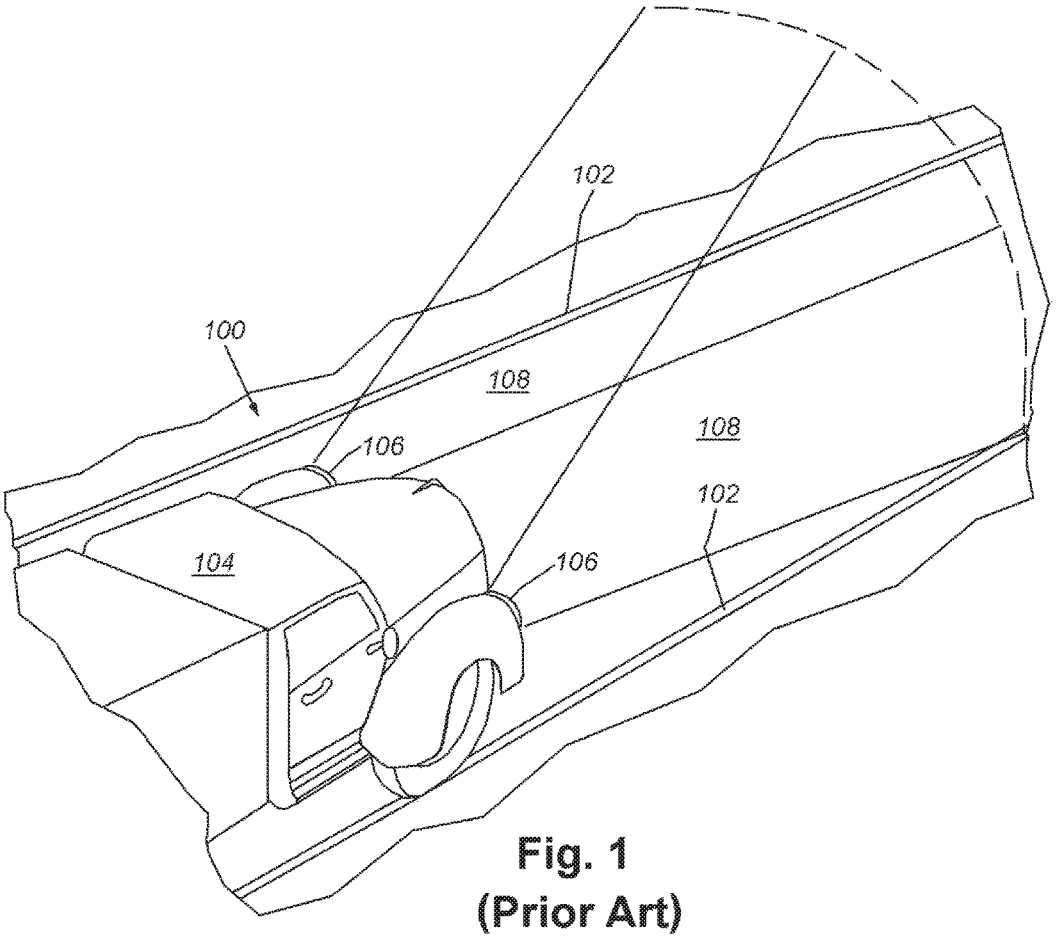
Fig. 1 (Prior Art)
FIG. 1, already described, is a view of a vehicle traveling along a road way under reduced visibility conditions, according to the prior art.
Figure 2:
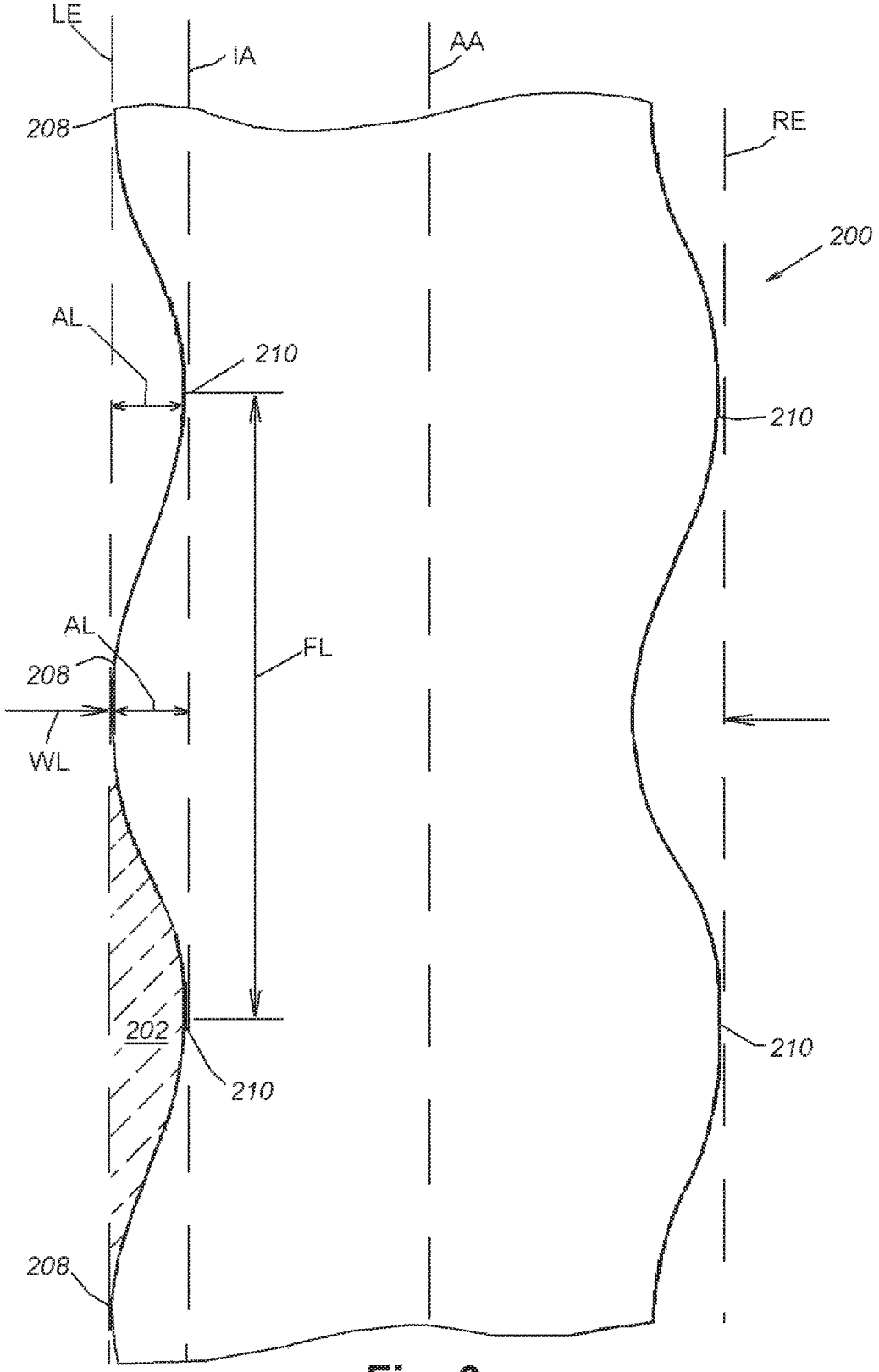
FIG. 2 is a view of a portion of an illustrative traffic line, according to an embodiment.

A portion of an illustrative sinusoidal traffic line 200 is shown in FIG. 2 and is defined as resembling a sine wave in shape. The sinusoidal lines are formed by "scalloping" the edges, that is to say, by omitting material by removal or non-application. LE is the axis of the left side edge of a traffic line and RE is the axis of the right side edge of a traffic line, relative to the center axis AA of the traffic line. The scalloping can be created by omitting material from the lines during their application, so that there are areas 202 of omitted material. The scalloping pattern is regular and is constructed and arranged as a sine wave relative to the vector AA of the line. In an embodiment, a pattern of the wavy left edge corresponds to and is identical to a pattern of the wavy right edge and is in phase. The inner limit axis IA of the sine-wave shaped outer edge line is proportionate and congruent to the outer left side edge LE. The shape of the outer line is comprised of "crests" 208 and "troughs" 210.

The amplitude AL of the sine wave shaped edge, the distance between the illustrative left side edge axis LE and the inner limit axis is approximately 1-2 inches. The wavelength of the sine wave shaped edge, that being the distance between respective adjacent centers of troughs 210 and/or adjacent centers of crests 208 is approximately 4-6 inches. It is expressly contemplated that the amplitude can be arranged to be greater or lesser as desired by the engineer, based on the conditions of the roadway and speed of vehicles upon it. While the omission of material from the line narrows the actual width WL of the line, the apparent line width WL is approximately 4 inches, the distance from the left side edge axis LE to the right side edge axis RE. The line 200 is arranged so that the sine-wave shape of the left edge and the shape of the right side are aligned and synchronized.

The omission of the material to create the sinusoidal line can be accomplished by a mechanism that induces a sinusoidal movement to produce a line having the desired amplitude AL and wavelength FL or by providing a ready made, formed ribbon that is pre-cut in a sinusoidal pattern. The omission of material to create the sinusoidal lines can reduce the overall material requirements for creating the line by approximately 20-30 percent, greatly reducing road costs at creation and maintenance. The longitudinal wavelength and lateral amplitude can be varied greater and lesser depending on the prevailing travel speed of the underlying road.

Figure 3:
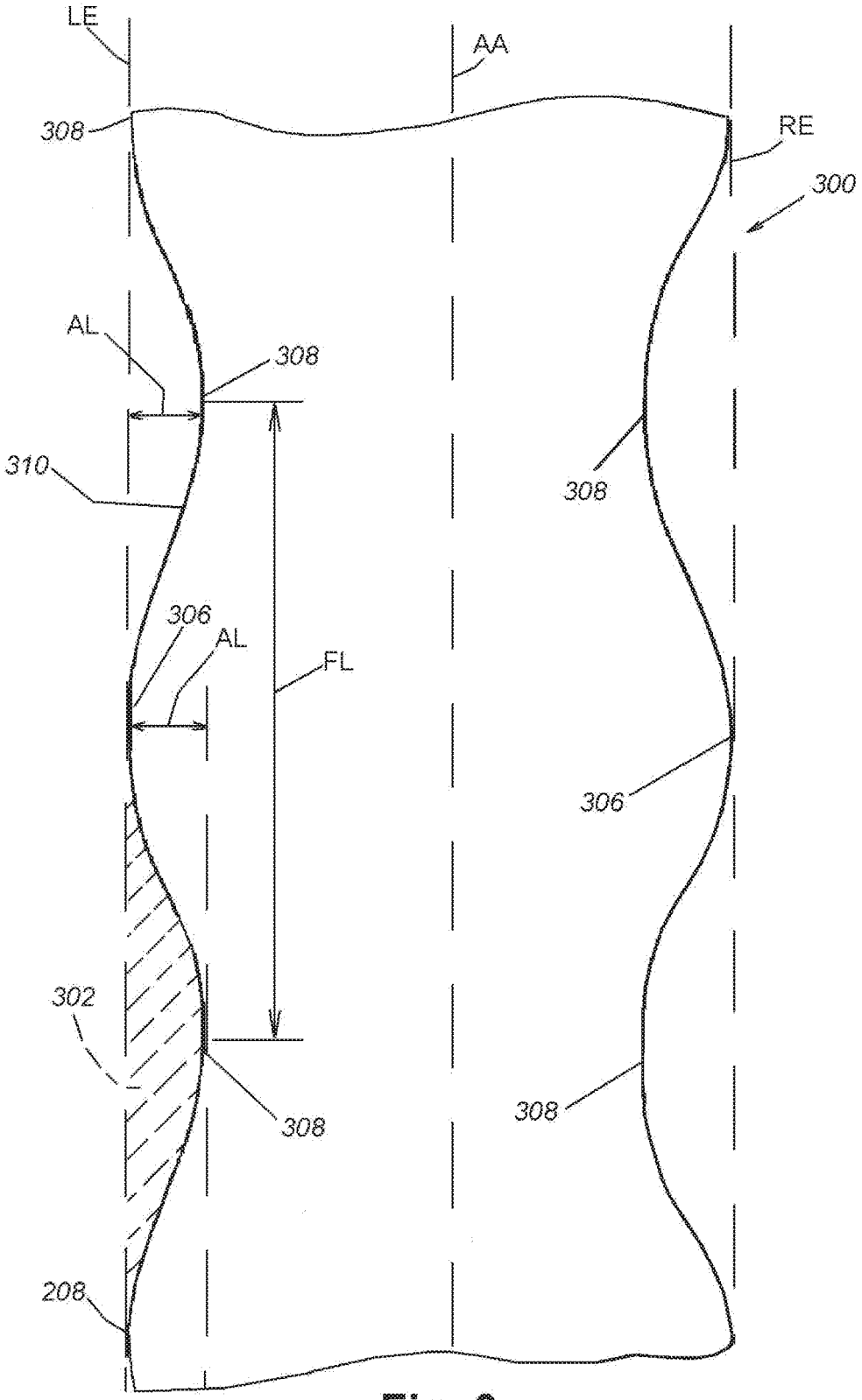
FIG. 3 is a view of a portion of an illustrative traffic line, according to an alternate embodiment.

FIG. 3 depicts a sinusoidal traffic line 300 that is arranged so that the crests 306 and troughs 308 are counterpoised and asynchronous, according to another embodiment. The shapes of the lines are formed and arranged as set forth above, and include regions 302 of omitted material. This creates a series of relatively wide and narrow segments. The sinusoidal wavy lines are 180 degrees out of phase and have opposing amplitudes. The overall visual effect to the traveler of synchronous and asynchronous lines when viewed at a distance of approximately 10 feet at a relatively low angle of 2-3 degrees is that the line is not scalloped. Therefore, travelers would not be upset by the scalloping. The sine-shaped waves are more visible than the lines in the prior art because the scalloped edges create small areas of black between the crests and troughs and an enhancement of the reflective areas of the line. This makes the lines appear to be relatively "brighter".

Figure 4:
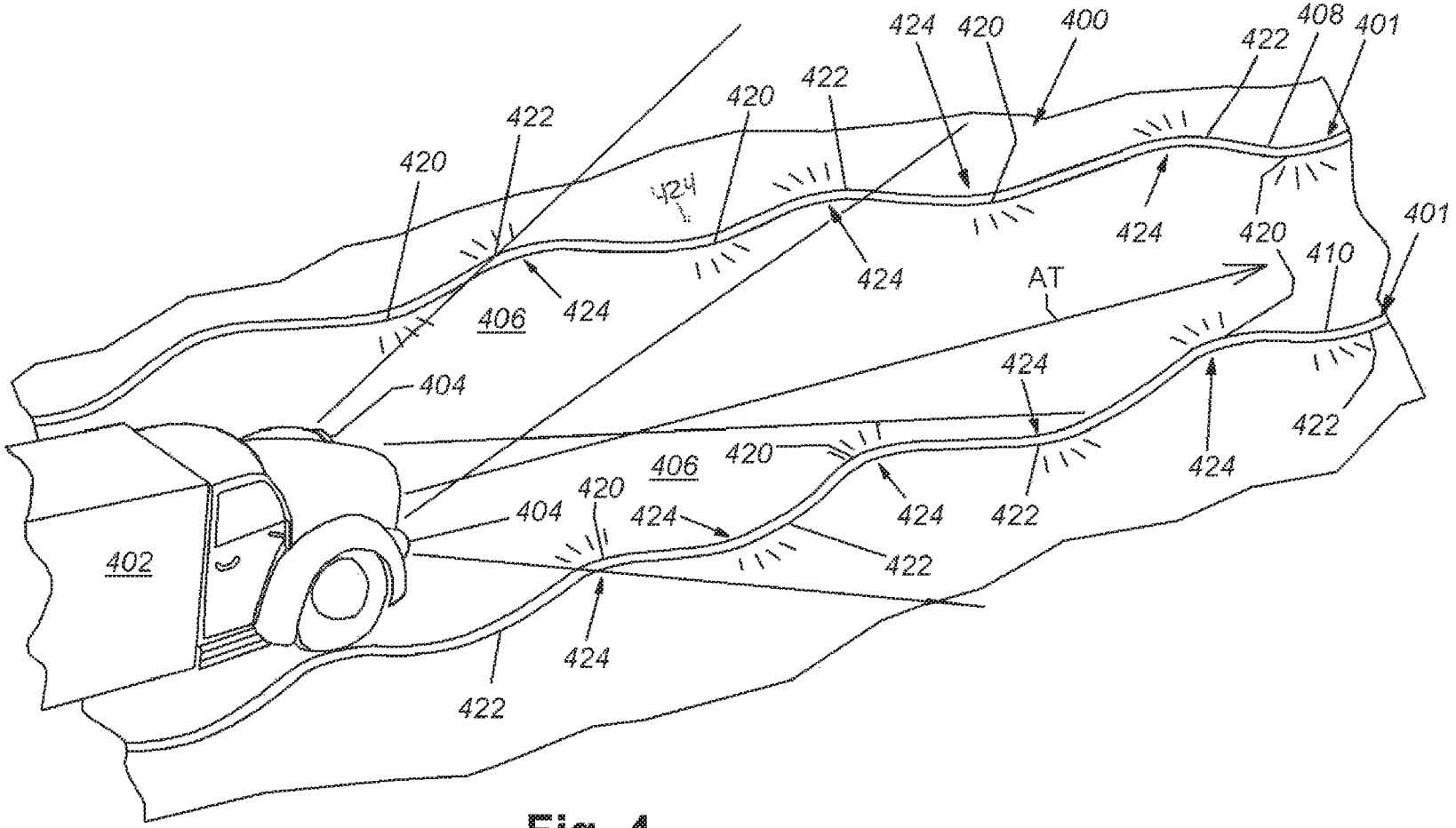
FIG. 4 is a view of a vehicle traveling along a road way under reduced visibility, according to the illustrative embodiment.

FIG. 4 shows a segment of a roadway 400 provided with sinusoidal traffic lines 401 is traveled by a vehicle 402 that is moving along the axis of travel AT. The truck's headlights 404 cast beams 406 that illuminate the roadway 400. The troughs 420 and crests 422 appear bright against the intervening omitted areas 424. The visual effect to the vehicle driver (not shown) presents a set of traffic lines that are relatively brighter than linear parallel lines.

Figure 5:
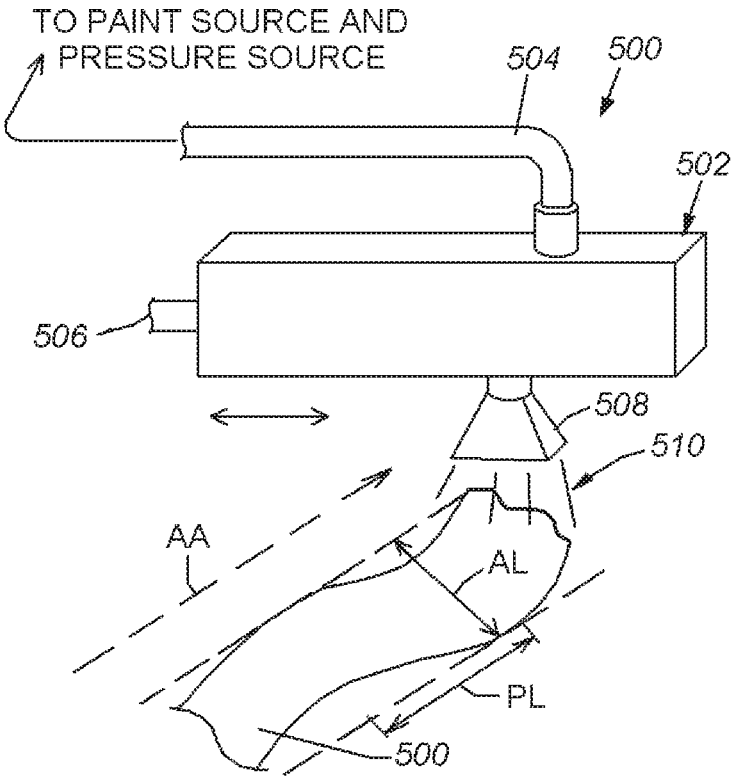
FIG. 5 is a view of a portion of an applicator for applying sinusoidal traffic lines to a road way surface, according to an illustrative embodiment.

A portion of a spray applicator 500 for creating the sinusoidal traffic line is shown in FIG. 5. The applicator can be vehicle mounted device or part of a walk-behind manually operated paint device. The applicator head 502 is provided with a feed line 504 that delivers the pressurized, heated and mixed paint solution from the source to the applicator head 502. The applicator head is selectively motivated back and forth in a lateral orientation by a drive shaft 506 or similar device that is motor-driven and moves the head 502 back and forth a distance equal to the designated amplitude of the line AL and at a rate that creates the desired wavelength of the line FL as the applicator 500 travels along the axis of the line AA at a pre-determined rate of travel. The pressurized, heated and mixed solution is dispersed through the spray nozzle 508 at the desired width and is arranged to travel at an elevation above the road to produce a line of the desired thickness.

Figure 6:
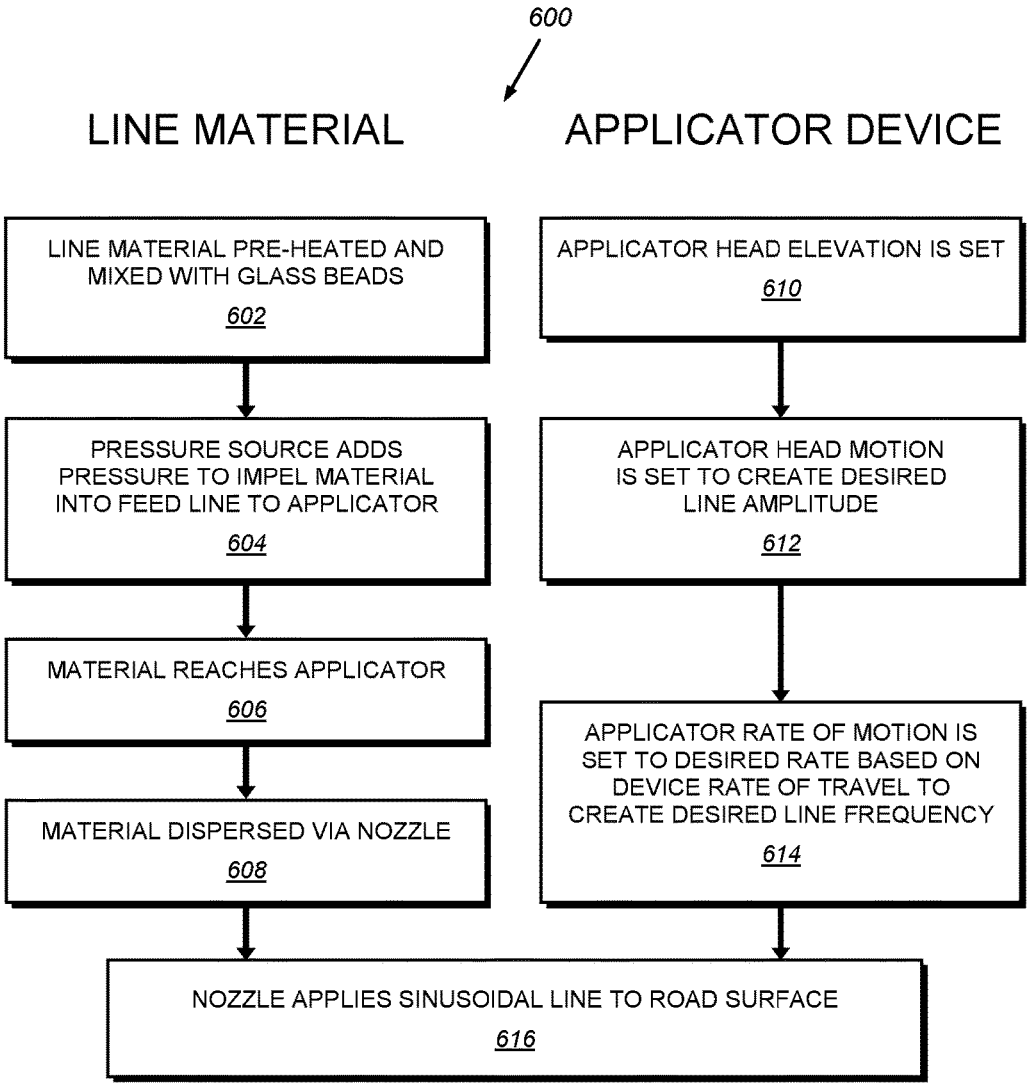
FIG. 6 is a schematic diagram of the steps in the application of material to create sinusoidal traffic lines, according to the illustrative embodiment.

The control process 600 of applying traffic line material to create sinusoidal traffic lines is set forth in FIG. 6. The line material ingredients are mixed in their appropriate quantities and are subjected to heating. When the mixture is sufficiently heated, glass beads are added to the mixture 602. Each of the glass beads catches and bends light that is projected at it, resulting in greater visibility of the traffic line. A pressure source, for example, an air compressor, adds pressure to the heated material and impels a portion of the material into the feed line 604. The feed line carries the material from the source to the applicator 606. The material is then dispersed through the nozzle, located in the applicator 606. The applicator head is arranged for dispersing the line material by first setting the elevation of the head relative to the roadway, so that the application is optimal for the circumstances 610. The applicator is then adjusted so that its distance of lateral travel will disperse the material in lines having the desired line amplitude 612. The applicator rate of motion is then set so that the speed of the device will create lines of the desired wavelength by coordinating the forward motion of the device with the lateral motion of the applicator head 614. The applicator nozzle is set at the desired elevation and having the desired lateral and forward motion to disperse the lines, can begin applying the material 616. In another embodiment having lines as set forth in FIG. 3, the applicator can be provided with more than one nozzle, each moving in an independent reciprocating action.

As noted previously, the addition of glass beads into the paint mixture results in greater visibility of traffic lines. The sinuous traffic lines that are laid out in the manner described above, combined with the glass beads, results in a greatly increased visibility of traffic lines, particularly during periods of reduced visibility, including during environmentally caused conditions such as fog, rain or fogsmoke. This in turn increases highway safety on the whole. Increasing the concentration of glass beads within the paint mixture will further improve traffic line visibility by action of the light projected onto a greater number of beads impregnated within the lines.

Figure 7:
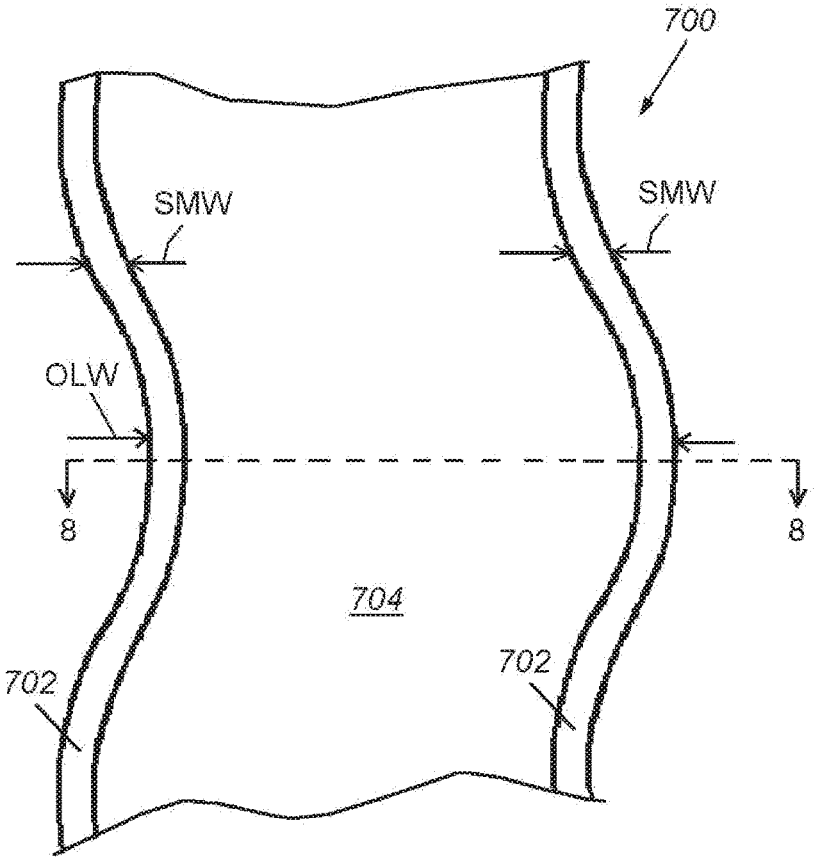
FIG. 7 is a portion of an illustrative traffic line, according to an embodiment.

FIG. 7 shows a segment of a sinuous traffic line. The line 700 has an overall line width OWL of approximately four inches (100 mm). The illustrative line is a contiguous assembly of three parallel line portions with two side margins 702 and a central line portion 704. The respective edges of the line 700 are the side margins 702, with the central line portion 704 located between the side margins 702, the side margins 702 being the outermost portions of the traffic line 700. In an illustrative embodiment, the width SMW of the side margin 702 is approximately ¼ inch (6.25 mm). In another embodiment, the width SMW of the side margin 702 is approximately ½ inch (12.5 mm). In an embodiment, the side margins are or equal width. In another embodiment, the widths of the side margins are not equal, and one side margin has a width that is different from the other. The central line portion 704 has a first portion with a concentration of glass beads within the paint, while the side margins 702 are together a second portion with a concentration of glass beads that is different from the first portion. The paint used to construct the central line portion 704 is a mixture of six pounds of glass beads per gallon. The paint mixture used to create each of the side margins 702 has an increased concentration of beads relative to the central line portion 704, with a concentration that is up to four times the concentration of the central line portion 704, for example, twenty-four pounds of glass beads per gallon of paint. In another embodiment, the concentration of glass beads can be more than six pounds per gallon of paint and less than twenty-four pounds per gallon of paint.

Figure 8:
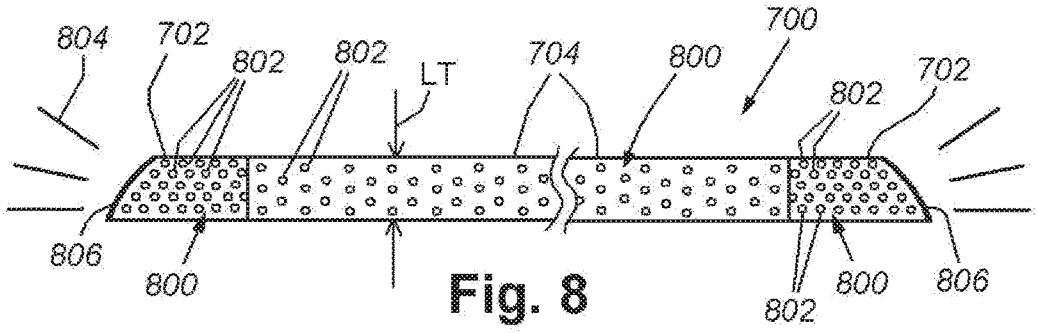
FIG. 8 is a cross section view along line 8-8 of FIG. 7, according to the embodiment.

FIG. 8 depicts the segment of traffic line with a super concentration of glass beads 802 in the line paint 800 mixture. The central line portion 704 has a concentration of beads at a mixture of six pounds per gallon ratio, while the side margins 702 have a concentration of glass beads 802 at a ratio of twenty-four pounds of glass beads per gallon. This leads to a greatly increased reflectivity 804 when light is projected over the traffic line. The line thickness LT creates two sidewalls 806 for the sidewalls. A traffic line has a thickness of approximately 30-35 mils. The increased bead concentration in the side margins 702 and in particular, the respective sidewalls 806 provide more reflective beads and thus, greatly increases visibility of the traffic lines.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. as used herein the directional terms, such as, but not limited to, "up" and "down", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a prevailing direction of the force of gravity. The lines and vehicles depicted are not to scale. Furthermore, while the foregoing describes a number of separate embodiments of the apparatus and method of the present invention, what has been described herein is merely illustrative of the application of the principles of the present invention. For example, the colors used can vary from white to yellow or another color. The lines can define regular sine-wave shaped lines or lines that alternate between "fat" and "thin". The wavelength and amplitude of the lines can vary. The longitudinal wavelength and lateral amplitude can be varied greater and lesser depending on the prevailing travel speed of the underlying road. The thermoplastic material composition can vary and line colors can vary. An embossing device can be used to create surface textures of various and diverse patterns upon the upper surface of the applied traffic line to increase reflectivity. This pattern can include a diamond pattern or another regular symmetric pattern. The movement of the applicator can be guided by a control process that includes GPS (Global Positioning System) for precise application. Accordingly, this description is meant to be taken only by way of example, and not to otherwise limit the scope of this invention.

What is claimed is:

1. A system of sinusoidal traffic lines comprising:

applied traffic lines that are arranged to have a wavy left edge and a corresponding wavy right edge so as to create a sinusoidal line in a directional vector along the axis of the traffic, a pattern of the wavy left edge being identical and corresponding to a pattern of the wavy right edge;

describing a contiguous assembly of three parallel line portions with a first portion having a concentration of glass beads per gallon of paint that is different from the concentration of glass beads per gallon of paint of a second portion;

the second portion being the outermost portions of the traffic line.

2. The system as set forth in claim 1 wherein concentration of glass beads in the paint within the second portions is four times that of the first portion.

3. The system as set forth in claim 1 wherein the sinusoidal traffic line increases visibility of the traffic lines in periods of reduced visibility.

4. The system as set forth in claim 1 wherein each of the second portions has a different width relative to the other.

5. The system as set forth in claim 1 wherein the each of the second portions is a side margin with a width of one quarter inch.

6. The system as set forth in claim 5 wherein the increased concentration of glass beads in the second portion is at a ratio of twenty-four pounds of glass beads per gallon of paint.

7. The system as set forth in claim 6 wherein the increased concentration of glass beads in the second portion increases the visibility of the edges of the traffic lines.

8. A traffic line comprising:

a traffic line applied to a road and defining a width and defining a lengthwise center axis, wherein at least one edge of the traffic line defines a series of indentations, the indentations having widths less than the width of the applied traffic line.

9. The traffic line of claim 8, wherein the series of indentations are defined by an omission of a material of the applied traffic line.

10. The traffic line of claim 8, wherein the lengthwise center axis is a straight line, and wherein the material of the traffic line is applied to a road on the lengthwise center axis.

11. The traffic line of claim 8, wherein a lateral depth of the indentations is in a range from approximately 1-2 inches.

12. The traffic line of claim 8, wherein a reflective upper surface of the applied traffic line is embossed with a diamond or other pattern in the surface of the line.

13. The traffic line of claim 8, wherein the series of indentations have widths no more than half of the width of the applied traffic line.

14. The traffic line of claim 13, wherein the series of indentations are defined by an omission of a material of the applied traffic line.

15. The traffic line of claim 8, wherein a distance from a first center of a first indentation to a second center of a second indentation is in a range from approximately 4-6 inches.

16. The traffic line of claim 15, wherein the distance can be varied depending on the prevailing travel speed of the underlying road.

17. The traffic line of claim 8, wherein the series of indentations define a sinusoidal pattern.

18. The traffic line of claim 17, wherein a lateral depth of the indentations is in a range from approximately 1-2 inches.

19. The traffic line of claim 17, wherein a distance from a first center of a first indentation to a second center of a second indentation is in a range from approximately 4-6 inches.

20. The traffic line of claim 19, wherein the distance can be varied depending on the prevailing travel speed of the underlying road.

* * * * *